US007340855B2

(12) United States Patent
Wiltfang et al.

(10) Patent No.: US 7,340,855 B2
(45) Date of Patent: Mar. 11, 2008

(54) SHELF SIGN HOLDER

(75) Inventors: Rohland Wiltfang, West St. Paul, MN (US); Christine Welsh, Stillwater, MN (US); Randy M. Staples, New Richmond, WI (US)

(73) Assignee: Target Brands, Inc., Minneapolis, MN (US)

( * ) Notice: Subject to any disclaimer, the term of this patent is extended or adjusted under 35 U.S.C. 154(b) by 303 days.

(21) Appl. No.: 10/942,162

(22) Filed: Sep. 16, 2004

(65) Prior Publication Data

US 2006/0053670 A1 Mar. 16, 2006

(51) Int. Cl.
*G09F 3/18* (2006.01)

(52) U.S. Cl. ..... 40/611.03; 40/661; 40/1.6; 40/651; 40/666; 40/649; 40/658; 248/220.21; 248/220.41; 248/223.41; 248/224.51

(58) Field of Classification Search ..... 40/661.03, 40/651, 661, 1.6; 248/220.41
See application file for complete search history.

(56) References Cited

U.S. PATENT DOCUMENTS 4,698,928 A 10/1987 Soporowski
5,394,632 A 3/1995 Gebka et al.
5,456,034 A * 10/1995 Lewis et al. ..... 40/666
5,458,307 A 10/1995 Gebka
5,553,721 A 9/1996 Gebka
5,682,698 A 11/1997 Bevins
5,899,011 A * 5/1999 Brinkman ..... 40/661.03
5,967,343 A 10/1999 Dufresne
6,105,295 A * 8/2000 Brinkman et al. ..... 40/661.03
6,145,232 A 11/2000 Bevins
6,163,996 A 12/2000 Gebka
6,490,820 B1 12/2002 Weakley
6,553,702 B1 4/2003 Bacnik
6,568,112 B2 5/2003 Lowry et al.
6,581,314 B2 6/2003 Valiulis
2003/0014893 A1 * 1/2003 Lowry ..... 40/661.03
2003/0097775 A1 5/2003 Lowry et al.
2003/0098400 A1 5/2003 Fast et al.

* cited by examiner

*Primary Examiner*—Katherine Mitchell
*Assistant Examiner*—Marcus Menezes
(74) *Attorney, Agent, or Firm*—Dicke, Billig & Czaja, PLLC

(57) ABSTRACT

A sign holder including a main portion, a flange, and an interface hook. The main portion longitudinally extends in a substantially planar manner and defines a top end, a bottom end opposite the top end, a first surface, and a second surface opposite the first surface. The flange is folded back from the bottom end toward the top end and the first surface of the main portion. The flange is biased toward the first surface of the main portion. The interface hook is folded back from the top end toward the second surface and the bottom end of the main portion and is configured to receive a portion of a shelf assembly to couple the sign holder to the shelf assembly. A pocket is defined between the main panel and the flange and is configured to receive a printed medium. Display systems and methods of use provide additional advantages.

27 Claims, 3 Drawing Sheets

SHELF SIGN HOLDER

BACKGROUND OF THE INVENTION

Businesses typically use a wide variety of display systems to display products and related information to consumers. In order to draw attention to the products displayed and/or to assist the consumer in locating the particular product for which they are searching, additional signs or other indicating means are becoming increasingly important. Such signs are typically mounted to the display systems to indicate the type of product, brand of product, advertising, sale status indicator, department, or other information relating to the displayed products and generally helpful to the consumer.

The above-described signs are generally positioned to correspond with particular products placed upon shelves, pegs, or other display devices. Signs of this type should be securely mounted to the shelf or display system to prevent inadvertent removal of the sign from the display, be effective in communicating the indicated information such as the product type, brand name, logo, etc., to the consumer, be aesthetically pleasing to consumers so as not to distract from the product display itself, and be configured so as not to interfere with inventory or other display maintenance activities.

SUMMARY OF THE INVENTION

One embodiment of the present invention relates to a sign holder for interfacing with a shelf assembly for displaying goods and for supporting a printed medium. The sign holder includes a main portion, a flange, and an interface hook. The main portion longitudinally extends in a substantially planar manner and defines a top end, a bottom end opposite the top end, a first surface, and a second surface opposite the first surface. The flange is folded back from the bottom end toward the top end and the first surface of the main portion. The flange is biased toward the first surface of the main portion. The interface hook is folded back from the top end toward the second surface and the bottom end of the main portion and is configured to receive a portion of the shelf assembly to couple the sign holder to the shelf assembly. A pocket is defined between the main panel and the flange. The pocket is configured to receive the printed medium. Other features and advantages are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
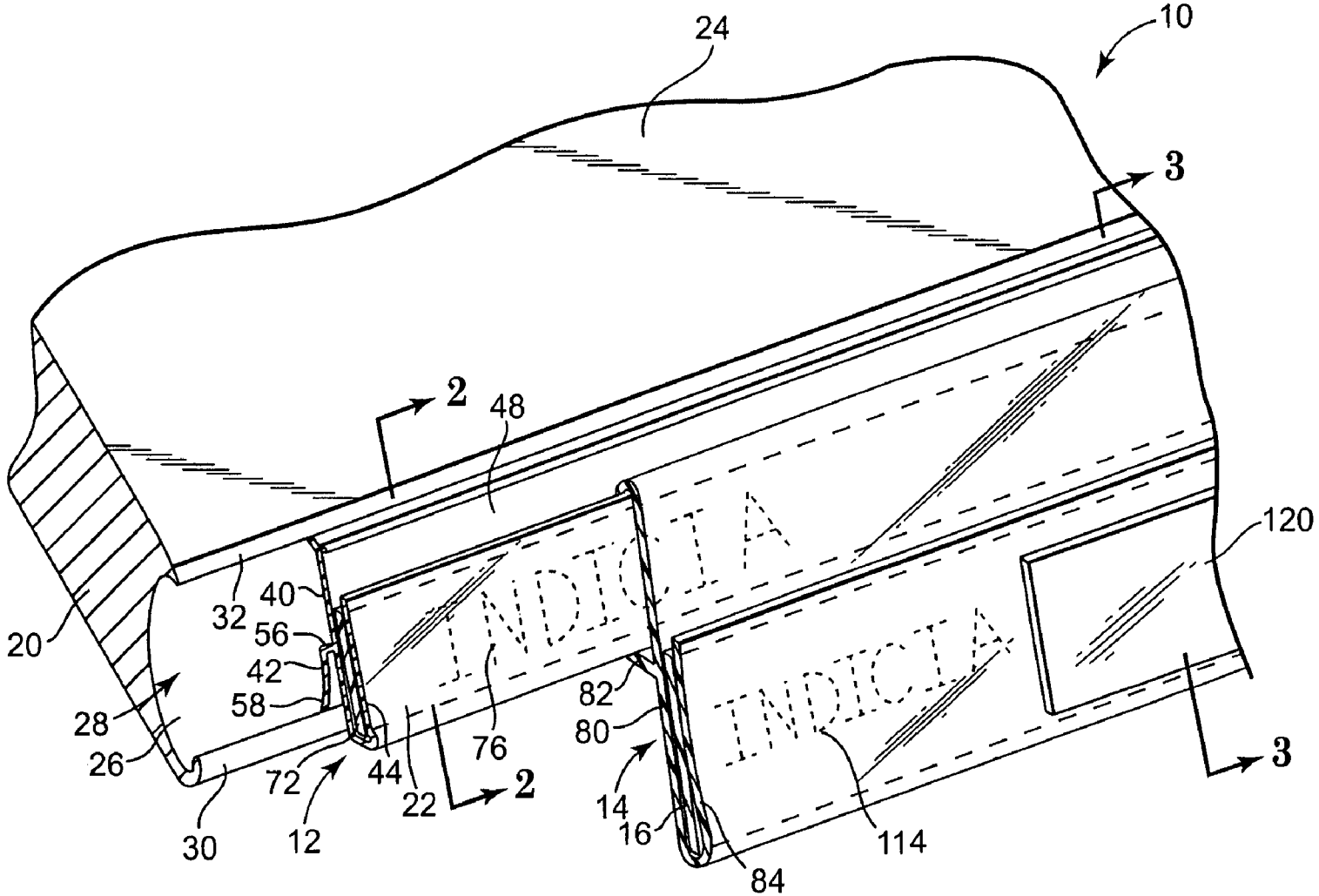
FIG. 1 is a perspective view illustrating one embodiment of a display system including a sign holder, according to one embodiment of the present invention.

FIG. 1 illustrates one embodiment of a display system 10 according to the present invention. The display system 10 includes a shelf assembly 12, a sign holder, or media display 14, and a sign or printed medium 16. Shelf assembly 12 is configured to hold and support any plurality of goods (not illustrated) offered for sale. Sign holder 14 attaches to shelf assembly 12 to maintain printed medium 16 positioned relatively near to the corresponding goods supported by shelf assembly 12. With this in mind, printed medium 16 can aid a consumer in finding a particular good or in learning more about a particular corresponding good maintained by shelf assembly 12.

Shelf assembly 12 includes a shelf 20 and a media support bracket 22. Shelf 20 defines an upper support surface 24 for supporting goods or other materials and a front surface 26 defining an open channel 28. In one embodiment, open channel 28 is a substantially C-shaped channel opened from front surface 26 away from the remainder of shelf 20. Open channel 28 defines a bottom, up-turned edge 30 and a top, down-turned edge 32. In one embodiment, open channel 28, and therefore edges 30 and 32, extend longitudinally along front surface 26 of shelf 20.

Figure 2:
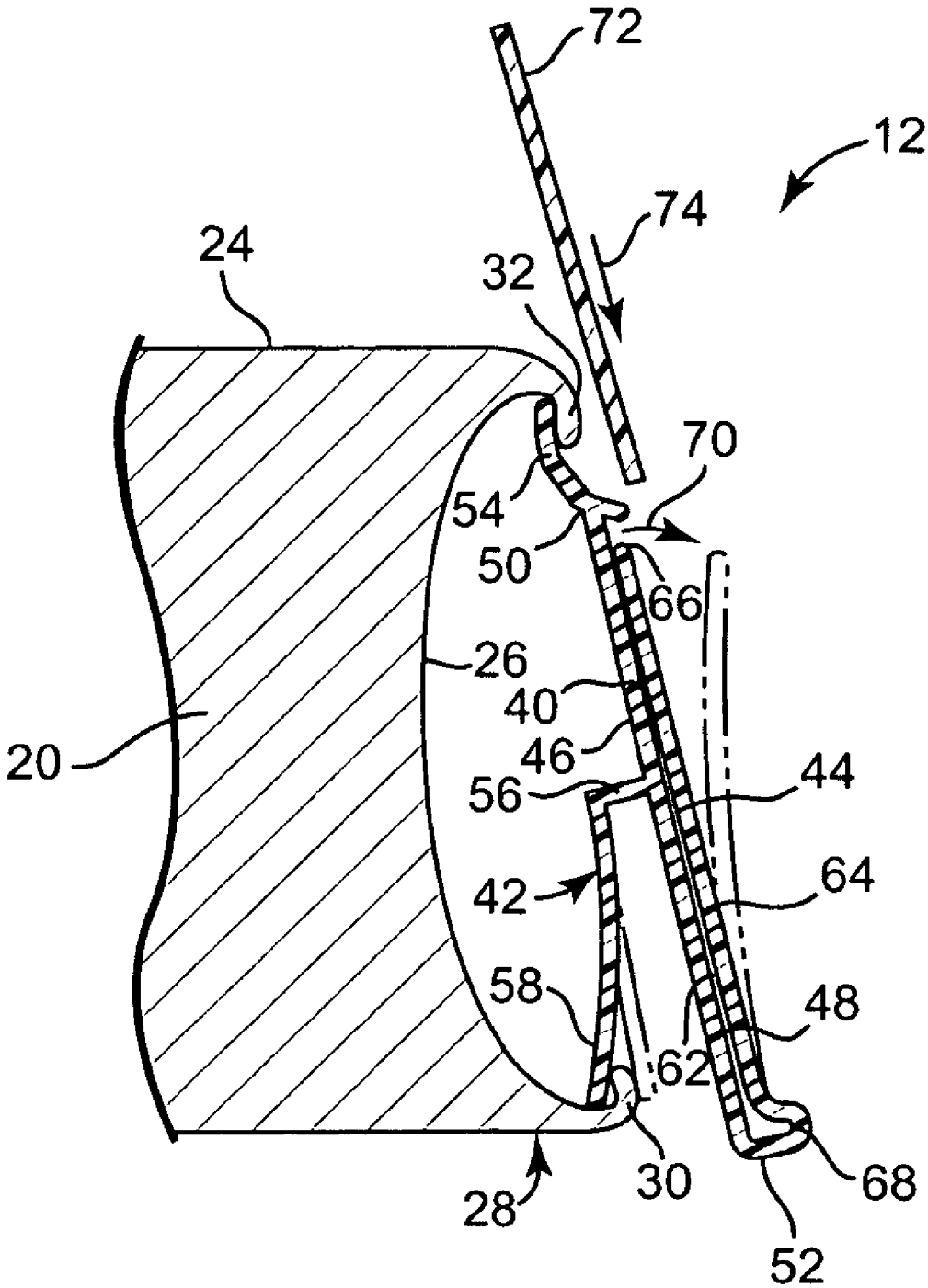
FIG. 2 is a cross-sectional view of a shelving system of the display system taken along the line 2-2 of FIG. 1, according to one embodiment of the present invention.

Media support bracket 22, as illustrated with additional reference to FIG. 2, includes a main panel 40, a back extension 42, and a return flange or flap 44. In one embodiment, main panel 40 is substantially planar and, accordingly, defines a back surface 46, a front surface 48 opposite back surface 46, a top longitudinal edge 50, and a bottom longitudinal edge 52 opposite top longitudinal edge 50. In one embodiment, a channel interface portion 54 extends along top edge 50 of main panel 40 to interface with top, down-turned edge 32 of shelf 20.

Back extension 42 extends from back surface 46 of main panel 40 away from main panel 40. As such, back extension 42 defines a shoulder portion 56 and a leg portion 58. In one embodiment, shoulder portion 56 extends away and downward from back surface 46 of main panel 40 in a substantially perpendicular manner. Leg portion 58 extends from shoulder portion 56 opposite main panel 40 in a downward manner generally parallel with the extension of main panel 40. Leg portion 58 is relatively flexible relative to main panel 40 in order to allow selective rotation or movement of leg portion 58 about its intersection with shoulder portion 56 as illustrated by the phantom lines of FIG. 2. However, leg portion 58 is biased to remain generally parallel with main panel 40.

Return flange 44 defines a back surface 62, a front surface 64, a top edge 66, and a bottom edge 68. In one embodiment, return flange 44 is integrally formed with main panel 40. In particular, bottom edge 68 of return flange 44 is coupled with bottom edge 52 of main panel 40. Return flange 44 extends from bottom edge 68 and turns or curves generally upward toward top edge 66 such that near top edge 66, back surface 62 of return flange 44 generally interacts with front surface 48 of main panel 40. More specifically, return flange 44 is biased toward front surface 48 of main panel 40. However, return flange 44 is flexible, relative to main panel 40, in order to allow rotation of return flange 44 about its intersection with bottom edge 68 as generally illustrated by arrow 70 in FIG. 2. In one embodiment, media support bracket 22 is extruded or otherwise formed of a plastic material. In one embodiment, main panel 40, and back extension 42 are formed of an opaque or slightly translucent material. In one embodiment, return flange 44 is formed of a transparent or substantially translucent material.

During assembly of shelf assembly 12, media support bracket 22 is coupled with shelf 20. In particular, main panel 40 of media support bracket 22 is placed with respect to open channel 28 of shelf 20 such that leg portion 58 of back extension 42 is placed behind bottom, up-turned edge 30 of open channel 28. In addition, channel interface portion 54 is placed behind or in back of top, down-turned edge 32 of shelf 20. In order to be positioned behind bottom, up-turned edge 30, in one embodiment, leg portion 58 is bent or rotated slightly back. Due to this slightly bent position, as opposed to the original orientation of leg portion 58, which is indicated by the phantom lines in FIG. 2, and the bias of leg portion 58 toward main panel 40, a slight tension is placed upon open channel 28, thereby maintaining media support bracket 22 positioned with respect to shelf 20. Although described above as comprising a separate shelf 20 and media support bracket 22, in one embodiment, shelf assembly 12 is integrally formed as one homogenous piece. In such an embodiment, shelf 20 itself may define flexible return flange 44.

In one embodiment, during assembly of shelf assembly 12, return flange 44 is rotated as illustrated by arrow 70 and the phantom lines of FIG. 2 away from main panel 40. While rotated away from main panel 40, a printed medium, or sign 72 is slid between main panel 40 and return flange 44 as generally illustrated by arrow 74. In an alternative embodiment, printed medium 72 is longitudinally slid between media panel 40 and return flange 44 from a side of media support bracket 22. More specifically, upon final positioning of printed medium 72 between main panel 40 and return flange 44, printed medium 72 interacts with front surface 48 of main panel 40 and back surface 62 of return flange 44. Upon removal of the rotating force indicated by arrow 70 from return flange 44, the bias of return flange 44 causes return flange 44 to rotate in the opposite direction as indicated by arrow 70 to interact with and apply a force to printed medium 72 to thereby hold printed medium 72 in place between media panel 40 and return flange 44, as illustrated in FIG. 1.

Printed medium 72 is any relatively thin media, such as paper, card stock, film, paper board, etc., printed with indicia 76. In one embodiment, indicia 76 relates to or includes information identifying the product or goods stored directly above on shelf 20, such as information relating to a price, a manufacturer, a brand identifier, a UPC, a bar code, etc. In an embodiment in which return flange 44 is transparent or translucent, indicia 76 of printed medium 72 can be read through return flange 44. In one embodiment in which indicia 76 includes a UPC, bar code, or other scannable representation, indicia 76 can be scanned or read through the transparent or translucent return flange 44. With this in mind, indicia 76 can be scanned or read without removing printed medium 72 from media support bracket 22. In one embodiment, printed medium 72 is a plurality of printed media.

Figure 3:
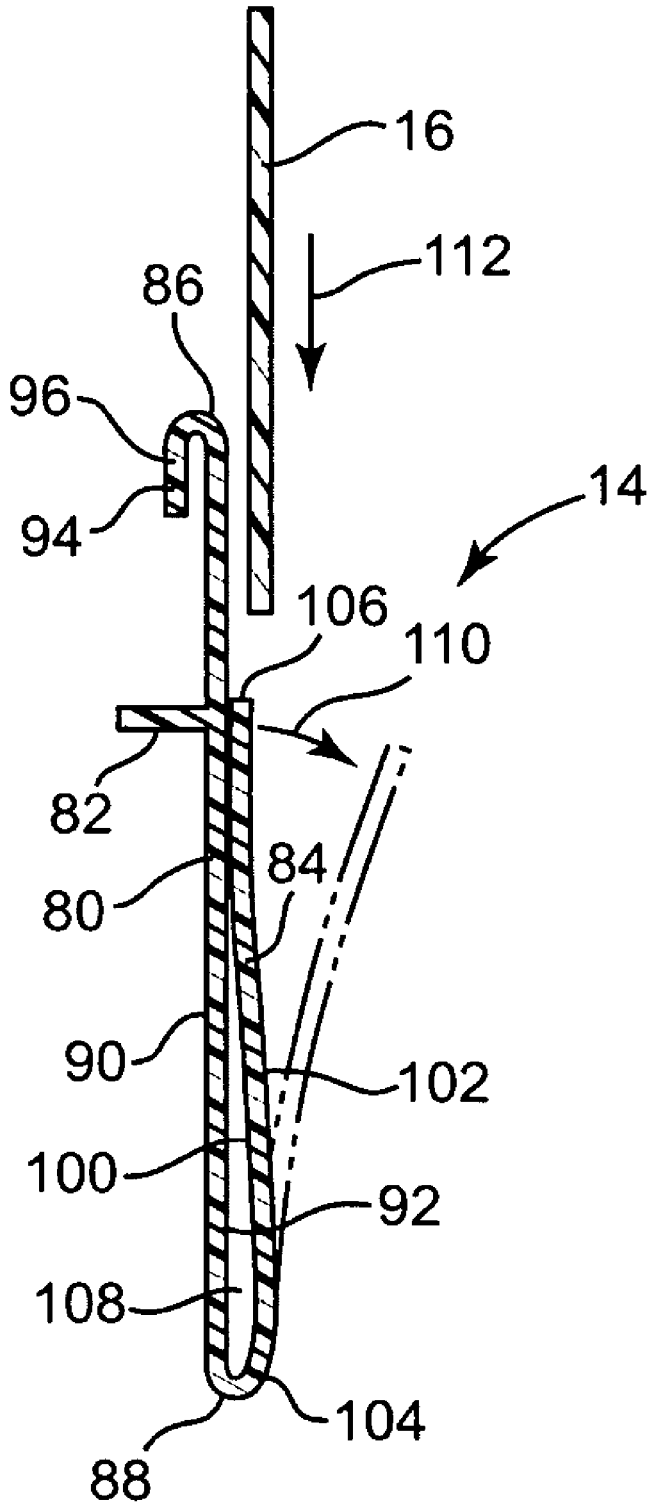
FIG. 3 illustrates one embodiment of a sign holder of the display system taken along the line 3-3 of FIG. 1, according to one embodiment of the present invention.

Collectively referring to FIGS. 1 and 3, sign holder 14 includes a main panel 80, a back rib or tab 82, and a return flange or flap 84. Main panel 80 extends in a substantially planar and longitudinal manner, as illustrated in FIG. 1. Main panel 80 defines a top longitudinal end 86, a bottom longitudinal end 88 opposite top. longitudinal end 86, a back surface 90, and a front surface 92 opposite back surface 90. In one embodiment, main panel 80 defines a hook or down-turned member 94 curling or bent over from top end 86 toward back surface 90 away from front surface 92. As such, a downward portion 96 of hook 94 extends substantially parallel with main panel 80. In one embodiment, hook 94 continuously extends longitudinally along top end 86. In one embodiment, hook 94 extends along a longitudinal portion or extends periodically along a plurality of longitudinal portions of top end 86.

In one embodiment, back rib 82 extends from back surface 90 of main panel 80 away from main panel 80 in a substantially perpendicular manner. In one embodiment, back rib 82 is positioned relatively nearer to top end 86 than bottom end 88 of main panel 80. Back rib 82 is positioned along main panel 80 to interact with bottom edge 52 of main panel 40 of media support bracket 22 or a bottom of shelf 20. In one embodiment, back rib 82 is positioned in a manner generally centered between top end 86 and bottom end 88. Back rib 82 is extruded as an integral piece with main panel 80 and return flange 84 or is separately formed from main panel 80 and return flange 84 and subsequently secured to main panel 80. In particular, in one embodiment, back rib 82 is formed of a foam material and adhered to a separately formed main panel 80.

Return flange 84 extends from bottom end 88 of main panel 80 in a generally up-turned manner. Return flange 84 defines a back surface 100, a front surface 102 opposite back surface 100, a bottom end 104, and a top end 106 opposite bottom end 104. Bottom end is coupled with bottom end 88 of main panel 80. In one embodiment, return flange 84 is substantially flexible and is biased toward main panel 80. More specifically, return flange 84 is biased such that back surface 100 of return flange 84 is biased to interact with a portion of front surface 92 of main panel 80. Accordingly, a pocket or sleeve 108 is defined between main panel 80 and return flange 84. With this in mind, main panel 80, return flange 84, and hook 94 collectively define sign holder 14 in generally S-shaped or an inverted S-shaped manner.

The flexible nature of return flange 84 allows return flange 84 to be rotated about its bottom end 88 interaction with main panel 80 as generally indicated by arrow 110. In one embodiment, sign holder 14 is extruded or otherwise formed of plastic. In one embodiment, at least one of main panel 80, return flange 84, and hook 94 is formed of a transparent or substantially translucent material. In one embodiment, main panel 80 and return flange 84 are each formed of a transparent or translucent material to allow printed media 72 and 16 to be viewed and/or scanned through the respective main panel 80 and return flange 84, as will be further described below.

Rotation of return flange 84 away from main panel 80 as indicated by arrow 110 allows printed medium 16 to be placed between return flange 84 and main panel 80 and into pocket 108 as indicated by arrow 112. In an alternative embodiment, printed medium 16 is longitudinally slid into pocket 108. In particular, printed medium 16 is positioned in pocket 108 to interact with front surface 92 of main panel 80 and back surface 100 of return flange 84. In one embodiment, pocket 108 is configured to accommodate printed medium 16 having heights in the range of about 1 inch to about 3 inches. In one embodiment, printed medium 16 is placed within pocket 108 prior to shipment of sign holder 14 to a displaying store to decrease the in-store labor necessary to install sign holder 14.

In one embodiment, printed medium 16 is any relatively thin printable media, such as paper, cardstock, paper board, etc., printed with textual and/or graphical indicia 114 indicating generalities about the products placed upon shelf 20 for display to a consumer. In one embodiment, indicia 114 of printed medium 16 includes generalized information relating to a number of particular items placed upon shelf 20. For example, in one embodiment, printed medium 16 is a product label including indicia 114 generally indicating the particular product being displayed upon shelf 20, further describing the individual products displayed upon shelf 20, etc. In particular, indicia 114 indicates at least one of product type, department, sale status, supply availability, item price, item name, and a bar code related to the goods displayed on the display shelf assembly. In one embodiment, indicia 114 includes a UPC, bar code, or other scannable portion, which can be scanned through return flange 84 when it is translucent or substantially transparent. In one embodiment, printed medium 16 is a plurality of printed media.

Sign holder 14 is configured to be selectively coupled with shelf assembly 12. In particular, referring to FIG. 1, sign holder 14 is positioned relative to shelf assembly 12 such that hook 94 is placed about top edge 66 of media support bracket return flange 44. Accordingly, the bias of return flange 44 toward main panel 40 of media support bracket 22 not only maintains printed medium 72 within media support bracket 22, but also maintains the position of downward extending portion 96 of hook 94 between main panel 40 and return flange 44.

In one embodiment, sign holder 14 is sized and configured such that upon coupling hook 94 with return flange 44 of media support bracket 22, back rib 82 extends just beneath bottom edges 52 and 68 of media support bracket 22 or the bottom of shelf 20. The position of back rib 82 with respect to shelf assembly 12 securely holds sign holder 14 with respect to shelf assembly 12 and decreases or generally prevents sign holder 14 from moving in an upward direction if sign holder 14 is moved or knocked by a passerby, such as a consumer or store associate. In particular, upon consumer or store associate interaction with sign holder 14, back rib 82 interacts with media support bracket 22 to decrease or generally prevent either rotation of sign holder 14 about media support bracket 22 or movement of hook 94 upward and away from return flange 44 of media support bracket 22, which otherwise may inadvertently uncouple sign holder 14 from shelf assembly 12.

In one embodiment, return flange 84 of sign holder 14 extends upward upon main panel 80 to a height along main panel 80 similar to the place back rib 82 extends from main panel 80. With this in mind, in one embodiment, printed medium 16 is entirely maintained beneath back rib 82. As such, positioning of sign holder 14 upon shelf assembly 12 allows a consumer to view both printed media 16 and 72 through the respective transparent return flanges 84 and 44. In particular, in one embodiment, either or both of printed media 16 and 72 can be scanned through the respective return flange(s) 84 and 44. In this manner, sign holder 14 can be added to existing signs or media support brackets 22 placed upon display shelves 20 without generally interfering with the typical use of shelf assembly 12. In other embodiments, sign holders 14 can be placed upon shelves defining a similar return flange 44 without already maintaining printed medium 72 or other product labels.

A display system including a sign holder according to the present invention allows additional information relating to displayed products to be provided to a consumer, guest, or store associate in addition to the particular item labels or other information already provided to a consumer via conventional media support brackets. The additional product label may allow groups of items to be categorized and displayed to a consumer to facilitate the consumer in locating the particular goods for which the consumer is interested in viewing and/or purchasing.

In other embodiments, the product label or printed medium maintained within the additional sign holder may indicate to a consumer that a particular group of items or single item is on sale without need for the store associate or workers to remove the original item label maintained within conventional media support brackets attached to the shelving units. As such, additional printed medium displayed for a customer is also protected from normal wear and tear due to the relative rigid nature of the sign holder as compared to the actual printed medium maintained by the sign holder itself. Accordingly, a sign holder according to the present invention provides marked improvements over conventional sign holders.

Although the invention has been described with respect to particular embodiments, such embodiments are for illustrative purposes only and should not be considered to limit the invention. Various alternatives and changes will be apparent to those of ordinary skill in the art. For example, as illustrated in FIG. 1, in one embodiment, sign holder 14 includes additional components, such as a mirror 120 or other additional object secured to the front surface 102 of return flange 84 to further enhance a consumer's shopping experience. Additional modifications and changes will be apparent to those of ordinary skill in the art.

What is claimed is:

1. A combination comprising:

a printed media holder for use with a display structure that displays products, the printed media holder comprising:

means for coupling the printed media holder with the display structure, means for maintaining an entirety of a printed medium relating to the displayed products, and means for connecting the means for coupling and the means for maintaining, wherein the means for coupling extends from the means for connecting in an opposite direction as the means for maintaining extends from the means for connecting, the means for connecting being one of transparent and substantially translucent; and a media support bracket configured to hang from a shelf;

wherein the printed medium is a first printed medium, a second printed medium is maintained by the media support bracket, and the means for coupling includes means for hanging the printed media holder from the media support bracket.

2. The combination of claim 1, wherein the printed media holder further comprises:

means for decreasing inadvertent uncoupling of the printed media holder from the display structure.

3. The combination of claim 1, wherein the means for maintaining the printed medium permits viewing and scanning of the printed medium while the printed medium is maintained within the means for maintaining.

4. The combination of claim 1, wherein the means for maintaining is biased toward the means for connecting.

5. The combination of claim 1, wherein the means for coupling, the means for maintaining, and the means for connecting collectively define an S-shape.

6. The combination of claim 1, further comprising a display structure including:

means for supporting goods; and means for receiving a sign coupled with the means for supporting and the means for coupling.

7. The combination of claim 1, wherein the second printed medium is visible when viewed through the means for connecting and a portion of the media support bracket, the portion of the media support bracket being one of substantially transparent and translucent.

8. A combination comprising:

a display structure that displays products, the display structure including:

means for supporting goods, and means for receiving a sign coupled with the means for supporting, wherein the means for supporting goods includes a channel front edge for receiving the means for receiving a sign; and a printed media holder for use with the display structure, the printed media holder comprising:

means for coupling the printed media holder with the display structure, means for maintaining an entirety of a printed medium relating to the displayed products, and means for connecting the means for coupling and the means for maintaining, wherein the means for coupling extends from the means for connecting in an opposite direction as the means for maintaining extends from the means for connecting, the means for connecting being one of transparent and substantially translucent.

9. The combination of claim 8, wherein the means for receiving includes a biased means for interfacing with the channel front edge of the means for supporting goods.

10. A sign holder for interfacing with a shelf assembly for displaying goods and for supporting a first printed medium, the sign holder comprising:

a main portion longitudinally extending in a substantially planar manner and defining a top end, a bottom end opposite the top end, a first surface, and a second surface opposite the first surface, the main portion being one of transparent and substantially translucent;

a flange folded back from the bottom end toward the top end and the first surface of the main portion, wherein the flange is biased toward the first surface of the main portion, and the flange extends upward a length less than a length of the main portion;

an interface hook folded back from the top end toward the second surface and the bottom end of the main portion, the interface hook configured to receive a portion of the shelf assembly to couple the sign holder to the shelf assembly;

a back rib extending from the second surface of the main portion and configured to interface with the shelf assembly to guard against inadvertent removal of the sign holder from the shelf assembly;

wherein a pocket is defined between the main portion and the flange, and the pocket is configured to receive the first printed medium, and wherein the main portion, the flange, the interface hook, and the back rib are integrally formed as a single piece.

11. The sign holder of claim 10 in combination with a shelf assembly including:

a shelf for displaying goods, and a media support bracket defining a main panel, a flap extending from and biased toward the main panel, and a back extension extending from and biased toward the main panel, wherein the back extension interfaces with a portion of the shelf such that the media support bracket extends from the shelf, and the media support bracket is configured to receive a second printed medium between the flap and the main panel;

wherein the interface hook of the sign holder is received by the flap of the media support bracket to maintain the sign holder relative to the media support bracket, and the flap is one of transparent and substantially translucent.

12. The combination of claim 11, wherein the second printed medium is visible when viewed through the main portion of the sign holder and the flap of the media support bracket.

13. A system configured to support a first printed medium and a second printed medium for display, the system comprising:

a sign holder for supporting the first printed medium, the sign holder comprising:

a main portion longitudinally extending in a substantially planar manner and defining a top end, a bottom end opposite the top end, a first surface, and a second surface opposite the first surface, a flange folded back from the bottom end toward the top end and the first surface of the main portion, wherein the flange is biased toward the first surface of the main portion, and an interface hook folded back from the top end toward the second surface and the bottom end of the main portion, the interface hook configured to receive a portion of a shelf assembly to couple the sign holder to the shelf assembly, wherein a pocket is defined between the main portion and the flange, and the pocket is configured to receive the first printed medium; and a media support bracket configured to be coupled to the shelf assembly for displaying goods and configured to maintain the second printed medium;

wherein the interface hook of the sign holder receives the media support bracket such that the sign holder hangs from the media support bracket, the main portion of the sign holder is one of transparent and substantially translucent, and the sign holder is positioned relative to the media support bracket such that the second printed medium is displayed through the main portion of the sign holder and a portion of the media support bracket that is one of transparent and substantially translucent.

14. The system of claim 13, wherein the media support bracket interfaces with an open channel front edge of the shelf assembly.

15. The system of claim 13, wherein the flange of the sign holder extends upward a length less than a length of the main portion of the sign holder.

16. The system of claim 13, wherein the main portion and the flange of the sign holder are integrally formed.

17. The system of claim 13, wherein the main portion, the flange, and the interface hook of the sign holder collectively define an S-shape.

18. A system configured to support a first printed medium and a second printed medium for display, the system comprising:

a sign holder for supporting the first printed medium, the sign holder comprising:

a main portion longitudinally extending in a substantially planar manner and defining a top end, a bottom end opposite the top end, a first surface, and a second surface opposite the first surface, a flange folded back from the bottom end toward the top end and the first surface of the main portion, wherein the flange is biased toward the first surface of the main portion, an interface hook folded back from the top end toward the second surface and the bottom end of the main portion, the interface hook configured to receive a portion of a shelf assembly to couple the sign holder to the shelf assembly, wherein a pocket is defined between the main portion and the flange, and the pocket is configured to receive the first printed medium, and a back rib extending from the second surface of the main portion; and a media support bracket configured to be coupled to the shelf assembly for displaying goods and configured to maintain the second printed medium; wherein the interface hook of the sign holder receives the media support bracket such that the sign holder hangs from the media support bracket.

19. The system of claim 18, wherein the back rib extends from the main portion with an orientation substantially perpendicular to the main portion.

20. The system of claim 18, wherein a top surface of the back rib is configured to interface with a bottom of the media support bracket to guard against inadvertent removal of the sign holder from the media support bracket.

21. A combination comprising:

a shelf for displaying goods;

a system configured to support printed media for display, the system comprising:

a sign holder for supporting a printed medium, the sign holder comprising:

a main portion longitudinally extending in a substantially planar manner and defining a top end, a bottom end opposite the top end, a first surface, and a second surface opposite the first surface, a flange folded back from the bottom end toward the top end and the first surface of the main portion, wherein the flange is biased toward the first surface of the main portion, and an interface hook folded back from the top end toward the second surface and the bottom end of the main portion, the interface hook configured to receive a portion of the shelf to couple the sign holder to the shelf, wherein a pocket is defined between the main portion and the flange, and the pocket is configured to receive a printed medium, and a media support bracket configured to maintain a printed medium, wherein the interface hook of the sign holder receives the media support bracket such that the sign holder hangs from the media support bracket;

wherein the media support bracket is coupled with the shelf;

wherein the media support bracket includes a flap for interacting with the interface hook of the sign holder to support the sign holder relative to the goods;

a first printed medium maintained within the pocket between the flange and the main portion, the first printed medium including first indicia indicating at least one of product type, department, sales status, supply availability, and a bar code related to goods displayed on the shelf; and a second printed medium maintained between the main portion and the flap of the media support bracket, the second printed medium including second indicia indicating at least one of item price, item name, and the bar code related to goods supported by the shelf and positioned to correspond with the second printed medium.

22. The combination of claim 21, wherein the shelf defines a C-channel front edge and the media support bracket interfaces with the C-channel front edge to secure the media support bracket along the C-channel front edge of the shelf.

23. The combination of claim 22, wherein the media support bracket defines a main panel, the flap, and a back extension extending from the main panel, the media support bracket being configured to maintain the second printed medium between the main panel and the flap, and the back extension including a leg biased toward the main panel and configured to receive and couple with an up-turned edge of the C-channel front edge of the shelf.

24. The combination of claim 21, wherein the media support bracket defines a main panel and the flap, and wherein the media support bracket is configured to maintain the second printed medium between the main panel and the flap.

25. The combination of claim 21, wherein the interface hook of the sign holder couples with the flap of the media support bracket to maintain the sign holder relative to the media support bracket.

26. The combination of claim 21, wherein the sign holder and the media support bracket are each generally one of translucent and transparent.

27. A display system comprising:

a shelf for supporting goods;

a media support bracket removably coupled to the shelf and defining a first pocket;

a first printed medium maintained within the first pocket;

a sign holder including:

a main panel longitudinally extending in a substantially planar manner and defining a top end, a bottom end opposite the top end, a first surface, and a second surface, the first surface and the second surface being defined on opposite sides of the main panel, the main panel being one of transparent and substantially translucent;

a flange folded from the bottom end of the main panel toward the top end and over the first surface of the main panel and toward the first surface of the main panel, wherein the flange is biased toward the first surface of the main panel and a second pocket is defined between the main panel and the flange, and an interface hook folded from the top end of the main panel toward the bottom end and over the second surface of the main panel and toward the second surface of the main panel; and a second printed medium maintained within the second pocket;

wherein the interface hook is at least partially received within the first pocket to couple the sign holder to the media support bracket such that the sign holder hangs from the media support bracket and the first printed medium and the second printed medium are simultaneously displayed, and wherein the second printed medium is displayed through the main panel of the sign holder and a portion of the media support bracket that is one of transparent and substantially translucent.

* * * * *